United States Patent [19]

Palmersheim et al.

[11] 4,359,931

[45] Nov. 23, 1982

[54] REGENERATIVE AND ANTICAVITATION HYDRAULIC SYSTEM FOR AN EXCAVATOR

[75] Inventors: Gerard M. Palmersheim, Dover; Robert D. Breeding, New Philadelphia, both of Ohio

[73] Assignee: The Warner & Swasey Company, Cleveland, Ohio

[21] Appl. No.: 225,941

[22] Filed: Jan. 19, 1981

[51] Int. Cl.[3] ..... F15B 13/04

[52] U.S. Cl. ..... 91/436; 91/441; 91/451

[58] Field of Search ..... 91/416, 436, 437, 441

[56] References Cited

U.S. PATENT DOCUMENTS

| | | | |
|---|---|---|---|
| 2,650,473 | 9/1953 | Bridwell | 91/436 X |
| 3,452,397 | 7/1969 | Newton | 91/416 X |
| 3,470,792 | 10/1969 | Darling | 91/441 X |
| 3,472,127 | 10/1969 | Scheidt | 91/437 |
| 3,654,833 | 4/1972 | Griffiths | 91/436 X |
| 4,046,270 | 9/1977 | Baron | 214/138 R |
| 4,063,489 | 12/1977 | Parquet | 91/445 |
| 4,152,970 | 5/1979 | Hall | 91/436 X |
| 4,174,732 | 11/1979 | Freese | 137/498 |
| 4,188,971 | 2/1980 | Otteson | 137/460 |
| 4,194,436 | 3/1980 | Imada | 91/436 X |
| 4,201,509 | 5/1980 | Hansen | 414/694 |
| 4,216,702 | 8/1980 | Brundidge | 91/436 |

*Primary Examiner*—Robert G. Nilson

*Attorney, Agent, or Firm*—Howard G. Massung

[57] ABSTRACT

A hydraulic system (40) for an excavator (10) which utilizes regeneration, minimizes cavitation, and provides hose break protection is disclosed. A valve assembly (50) is permanently connected to a hydraulic actuator (30) which is to be controlled. A hydraulic power supply (42) remote from the hydraulic actuator is connected to the valve assembly (50) through a pair of flexible hoses (56, 58). Pressurized hydraulic fluid can flow to the valve assembly through either of the flexible hydraulic hoses, but the valve assembly (50) includes a check valve (60) so hydraulic fluid return is only possible through one hose (56). A two position valve (62) is provided in the valve assembly (50) between a pair of operating ports (36, 38) on the hydraulic actuator (30). The two position valve (62) can be opened in response to a signal from the operator, connecting the two ports (36, 38) together to permit regeneration. The valve assembly (50) also includes a pressure relief valve (64) connected to one of the ports (38) to limit overpressure. A second check valve (66) is connected around the pressure relief valve (64) to permit hydraulic fluid to flow from a reservoir (43) to the hydraulic actuator (30). The reservoir (43) is pressurized at a relatively low pressure, so when the pressure at the associated port (38) drops below the reservoir pressure hydraulic fluid flows through the second check valve (66) to the port (38) and minimizes cavitation.

10 Claims, 7 Drawing Figures

REGENERATIVE AND ANTICAVITATION HYDRAULIC SYSTEM FOR AN EXCAVATOR

BACKGROUND OF THE INVENTION

1. Technical Field

This invention relates to hydraulic systems and more particularly to a hydraulic system particularly suitable for use on an extendable boom excavator.

2. Background Art

Material handling machinery such as hydraulic excavators of the type explained in U.S. Pat. Nos. 3,666,125 and 3,954,196 use hydraulic cylinders for raising and lowering the boom and also for extending and retracting the boom. It is desirable that the boom is not quickly lowered or extended in the event of a hose rupture. Various prior art patents such as U.S. Pat. Nos. 4,063,489 and 4,174,732 teach valves which automatically shut off fluid flow in response to pressure drop or increased flow rate which occur in the event of a line rupture.

DISCLOSURE OF THE INVENTION

The present invention provides a hydraulic system for controlling the operation of a hydraulic cylinder or actuator. The hydraulic actuator is movable between an extended position and a retracted position in response to pressurized hydraulic fluid supplied to one of a pair of operating ports. A valve assembly which includes a check valve is mounted directly to the hydraulic actuator and permits fluid flow from a hydraulic power supply to the hydraulic actuator through either of a pair of hydraulic hoses but permits return of hydraulic fluid through only one of the hoses. A regeneration valve which is responsive to an operator command is provided in the valve assembly and when closed prevents fluid communication between the two operating ports, but when open permits hydraulic fluid flow between the two operating ports. When the regeneration valve is open regeneration can occur. The valve assembly also includes a pressure relief valve connected to one of the ports for limiting overpressure. A check valve is provided around the pressure relief valve and permits fluid flow to the port when the pressure at the port drops below a predetermined value. The reservoir which is pressurized to a predetermined low value supplies fluid through the check valve to the associated port to minimize cavitation.

It is an object of this invention to teach a valve assembly for a hydraulic cylinder which provides hose break protection, utilizes regeneration, and minimizes cavitation.

BRIEF DESCRIPTION OF THE DRAWINGS

For a better understanding of the invention, reference may be had to the preferred embodiment exemplary of the invention shown in the accompanying drawings in which.

BEST MODE FOR CARRYING OUT THE INVENTION

Figure 1:
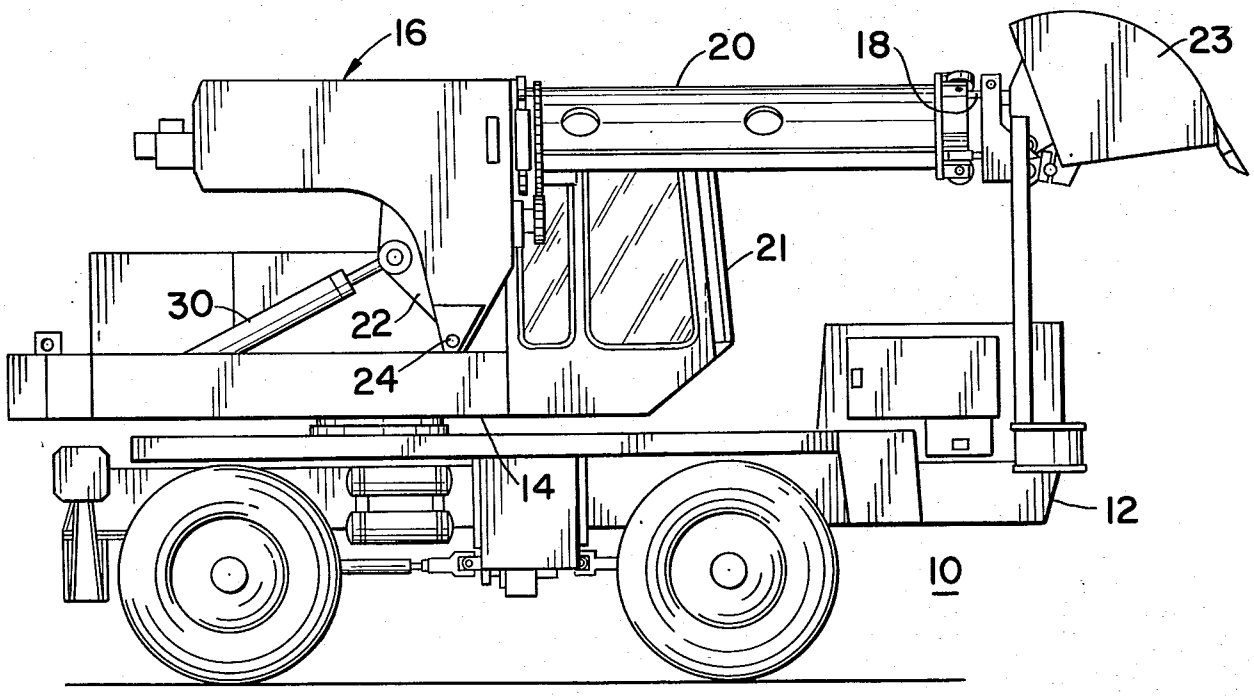
FIG. 1 is a side view of an extendable boom excavator on which a hydraulic system according to the teaching of the present invention can advantageously be utilized.

Referring now to the drawings and FIG. 1 in particular, there is shown an extendable boom excavator 10 which is particularly suitable for utilizing the invention of the present disclosure. Excavator 10 comprises a vehicle 12 including a rotatable platform 14 which supports a boom assembly 16. Boom assembly 16 includes an inner section 18 and an outer section 20 which are disposed in a telescopic relationship with each other. The outer boom section 20 is mounted on a cradle member 22 which is pivotally connected at a pivot connection 24 to a platform 14. The boom 16 and cradle 22 are raised or lowered by a hydraulic cylinder 30 which pivots cradle 22 about pivot connection 24. When hydraulic cylinder 30 is extended boom assembly 16 is lowered. When hydraulic cylinder 30 is retracted the boom assembly 16 is raised. The boom assembly 16 is extended and retracted by effecting relative movement between telescopically disposed inner and outer boom sections 18 and 20, respectively. A hydraulic cylinder assembly mounted within boom assembly 16 is extendable to move the inner boom section 18 axially outward relatively to the outer boom section 20 to thereby extend the telescopic boom assembly 16. Similarly, the hydraulic cylinder assembly is retractable to move the inner boom section 18 inwardly from the extended position to the retracted position. An operating mechanism is provided in boom assembly 16 to move boom sections 18 and 20 around their longitudinal axis.

During use, an operator is situated in cab 21 and controls positioning and movement of the bucket 23 connected to the end of the extendable boom section 18. The operator can raise or lower boom assembly 16, extend or retract inner boom section 18, and move bucket 23 around and relative to the longitudinal axis defined by boom sections 18, 20 in a well-known manner. A dangerous condition can occur if the boom 16 is suddenly dropped or if boom section 18 suddenly moves to an extended position due to a hose break with the resulting loss of hydraulic fluid. Due to gravity, loading on boom assembly 16 usually tends to lower boom assembly 16 or extend boom section 18.

Figure 2:
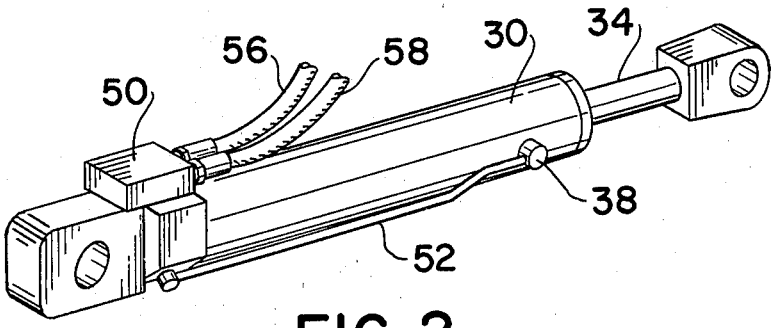
FIG. 2 is a view in perspective of a hydraulic actuator controlled according to the teaching of the present invention.
Figure 3:
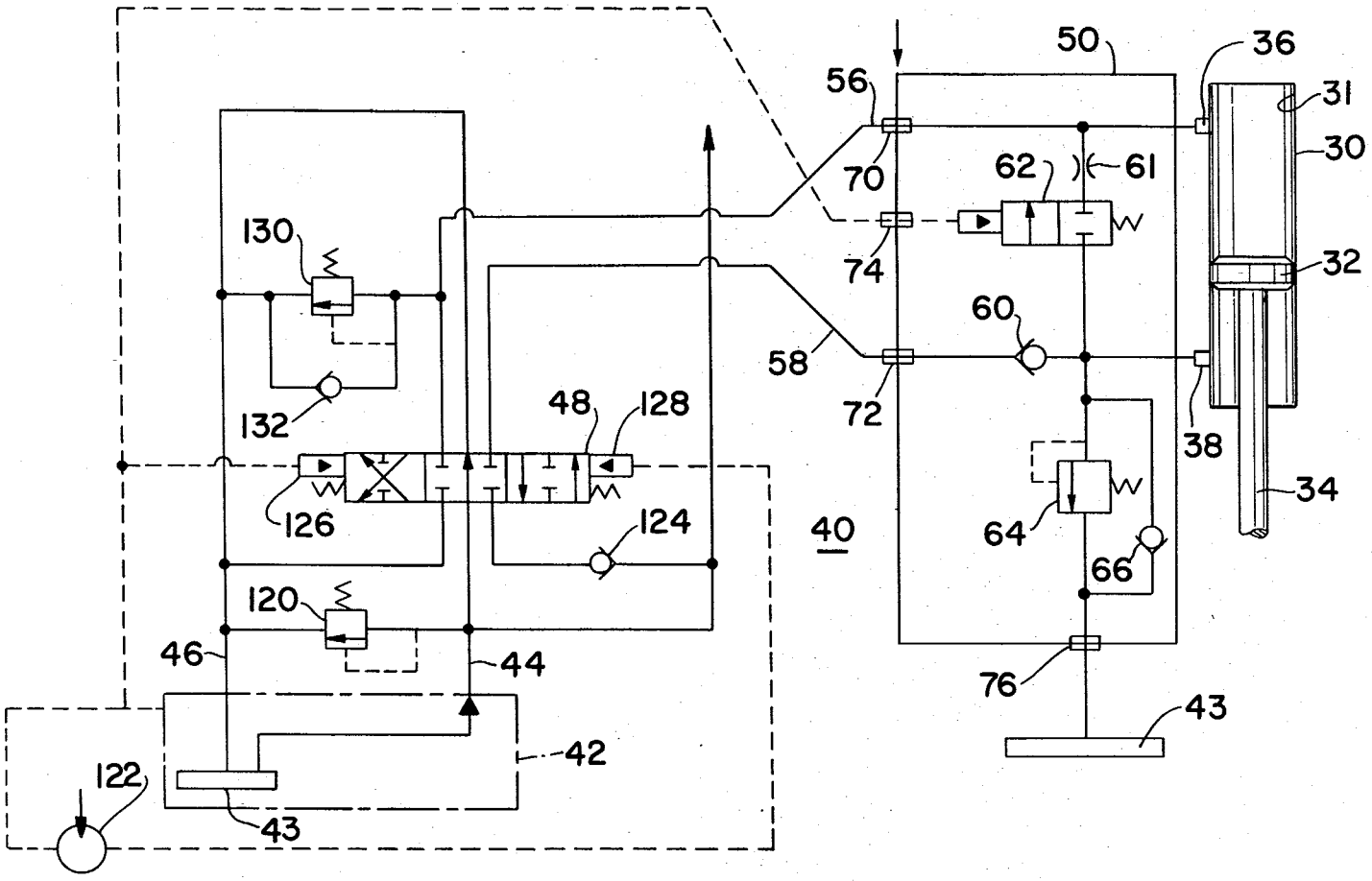
FIG. 3 is a schematic of a hydraulic circuit according to the teaching of the present invention.

Referring now to FIG. 3, there is shown a hydraulic circuit 40 constructed according to the teaching of the present invention. Hydraulic circuit 40 includes a valve assembly 50 which is directly mounted on hydraulic cylinder 30. As can best be seen in FIG. 2, valve assembly 50 is directly mounted on hydraulic cylinder or actuator 30. Hydraulic actuator 30 consists of a hydraulic cylinder chamber 31 within which is disposed a movable piston 32. An operating rod 34 is attached to piston 32 for movement therewith. The outer end of rod 34 is connected to position boom assembly 16 in response to the operator's command. A similar hydraulic actuator is used for positioning boom section 18. Actuator 30 has a pair of ports 36, 38 for positioning piston 32 and rod 34. When pressurized hydraulic fluid is fed into port 36 and vented through port 38 operating rod 34 will extend. When pressurized hydraulic fluid is fed into port 38 and vented through port 36 operating rod 34 will retract. A permanent metal tube 52 mounted in cylinder 30 connects port 38 to valve assembly 50. Flexible hydraulic hoses 56, 58 are connected to the valve assembly 50.

A hydraulic power supply 42 including a pressurized hydraulic supply outlet 44 and a return inlet 46 provide a source of hydraulic fluid for operating hydraulic cylinder 30. Hydraulic power supply 42 includes a reservoir 43 and a positive displacement pump which provides pressurized hydraulic fluid at a relatively high pressure. A four way three position direction control valve 48 is provided for controlling positioning of actuator 30 in response to an operator initiated pilot signal.

The supply output 44 of hydraulic power supply 42 has a main relief valve 120 connected thereto. Main relief valve 120 sets the hydraulic system pressure at approximately 2500 P.S.I. Direction control valve 48 is a three position valve which is spring biased to a center position and movable to a left or right side position in response to an appropriate pilot signal. Direction control valve 48 is moved to the right when a pilot signal is applied to control port 126 and moved to the left when a pilot signal is applied to control port 128. The pilot supply is controlled by a joy stick 122 in the operator's cab 21. When direction control valve 48 is moved to the left in response to the operator's positioning of the joy stick control 122 the output of hydraulic power supply 42 is connected through a load drop check valve 124 and direction control valve 48 to flexible hydraulic hose 58. At this time, flexible hydraulic hose 56 is connected through direction control valve 48 to the return line 46 which connects to reservoir 43. Positioning of direction control valve 48 to the left as viewed in FIG. 3 will cause operating rod 34 to retract in a manner which will be described in more detail hereinafter. When the direction control valve 48 is moved to the right in response to a pilot signal, the output 44 of hydraulic power supply 42 is connected to flexible hose 56 through direction control valve 48. At this time flexible hydraulic line 58 is connected through direction control valve 48 to return line 46. With the direction control valve moved to the right, rod 34 of actuator 30 will move to an extended position in a manner which will be described hereinafter in detail.

At its connection to direction control valve 48 flexible hydraulic line 56 has a hose relief valve 130 connected thereto. Relief valve 130 is set to prevent an overpressure in flexible hydraulic line 56. A check valve 132 is disposed around hose relief valve 130 to permit hydraulic fluid to flow from the reservoir 43 in hydraulic supply 42 into flexible hose 56. Check valve 132 will reduce cavitation due to an underpressure in the rear side of cylinder 30 which is served through port 36.

Flexible hose 56 connects at one end to direction control valve 48 and at the other end to valve assembly 50 through connector 70. Valve assembly 50 is directly connected to hydraulic cylinder 30. Valve assembly 50 has a check valve 60 and a two-way valve 62 formed therein. Check valve 60 permits hydraulic fluid to flow through flexible line 58 to port 38 but prevents hydraulic fluid from flowing from actuator 30 through valve assembly 50 into hydraulic hose 58. When a pilot signal is applied to the extend control port 126 of direction control valve 48 the output of hydraulic power supply 42 is connected to the flexible hose 56 and in turn through valve assembly 50 to port 36 causing actuator 30 to extend. When a pilot signal is provided to control port 126 on direction control valve 48, to move it to the right as seen in FIG. 3, the pilot signal is also applied to open two-way valve 62 connecting ports 36 and 38 and providing for fluid communication therebetween. Flexible hydraulic line 58 is connected through direction control valve 48 to return line 46, however, no return hydraulic fluid flows through hydraulic line 58 due to the presence of check valve 60. As fluid flows into port 36, causing piston 32 and rod 34 to move to an extended position, the hydraulic fluid in the rod end of chamber 31 exits through port 38, passes through two-way valve 62, and into port 36. This regenerative action speeds the movement of piston rod 34 to an extended position. An orifice 61 can be provided in the connection between ports 36, 38 to control the fluid flow therebetween. The difference in the area of piston 32 caused by the attachment of piston rod 34 to piston 32 provides the operating area for causing piston 32 to move to an extended position. The area differential determines the speed of movement and the force exerted by piston rod 34 when extended or retracted. Thus, for the operator to extend piston rod 34, he positions the joy stick to provide a pilot signal to control port 126 so as to move direction control valve to the right and also open two-way valve 62. As piston 32 moves to extend rod 34 fluid is forced from the rod end of cylinder chamber 31 to the rear end.

To retract rod 34 the joy stick is positioned to apply a pilot signal to control port 128 and move the direction control valve to the left. Pressurized hydraulic fluid is then supplied to port 38 through check valve 60 and two-way valve 62 is biased to the closed position. Port 36 is connected through valve assembly 50, flexible hose 56 and direction control valve 48 to return line 46. As piston 32 moves to the retracted position, fluid in the rear end of cylinder chamber 31 is forced through flexible hose 56 to the hydraulic supply reservoir 43.

To either extend the boom assembly 16 or to lower the boom assembly 16 a hydraulic cylinder must move to the extended position. It is desirable that the boom not uncontrollably extend or lower in the event of a hydraulic hose failure. With the present invention positive pressure and operator action is required to either extend or lower the boom assembly 16. This disclosed construction provides hose break protection in these instances. Since the fluid release from the piston rod side of the cylinder 30 does not return through hydraulic line 58 but rather is moved to the rear end of cylinder chamber 31, a break or rupture of flexible hydraulic line 58 will not cause the boom assembly to lower or extend. Even if the main hydraulic power from power supply 42 is lost the boom can be lowered in a controlled fashion by operating two-way valve 62. However, this positioning of boom assembly 16 is still under operator control. Under these circumstances orifice 61 will control the lowering speed of boom assembly 16. Thus, with no flexible hose used for returning the hydraulic fluid during extending of rod 34 there is very little possibility of uncontrolled lowering or extending of boom assembly 16.

Valve assembly 50 also includes pressure relief valve 64 and a parallel check valve 66. Pressure relief valve 64 is set at approximately 2900 P.S.I. to prevent excessive overpressure from developing at the rod end of cylinder 30. An overload could occur if there were too great a force tending to pull rod 34 to the extended position. Load drop check valve 124 prevents cylinder 30 from retracting if the load urging rod 34 to retract causes the pressure of the fluid in the rear end of cylinder 30 to exceed the system pressure. The load check valve 124 also prevents uncontrolled retraction of cylinder 30 if the system pressure is lost. Check valve 66 is connected between common hydraulic reservoir 43 and port 38 to permit fluid flow from the reservoir to port 38 if the pressure at port 38 falls beneath the reservoir pressure. The pressure of reservoir 43 is set at a relatively low back pressure of 40–60 P.S.I. This construction minimizes cavitation at the rod end of cylinder 30.

Normally, the excavators do not need protection against raising the boom in the event of a hose break since gravity tends to keep the boom down. Also the load on the bucket in an extendable boom excavator usually tends to extend the boom. To either lower the boom or extend the boom fluid must be vented from the rod side of cylinder 30. Venting of the return hydraulic fluid does not take place through hydraulic hose 58 but rather through valve assembly 50. Valve assembly 50 is directly connected to the cylinder housing 30 and controls the exiting of hydraulic fluid from cylinder 30 and thus provides hose break protection for extending cylinder 30. Positive pressure during normal operation is required to be applied to port 36 to extend or lower the boom 16. To extend boom 16 the only volume of pressurized hydraulic fluid required from the hydraulic supply 42 is equal to the volume of the rod 34 which is displaced. Without operator control piston rod 34 will not extend since check valve 60 prevents flow through flexible line 58 and two-way valve 62 is closed. The disclosed hydraulic system thus provides hose break protection, minimizes cavitation, and utilizes regeneration for faster operation. Other arrangements of the valves in valve assembly 50 to prevent return fluid from the rod end of cylinder 30 from flowing through line 58 and controlling its return path are possible.

Figure 6:
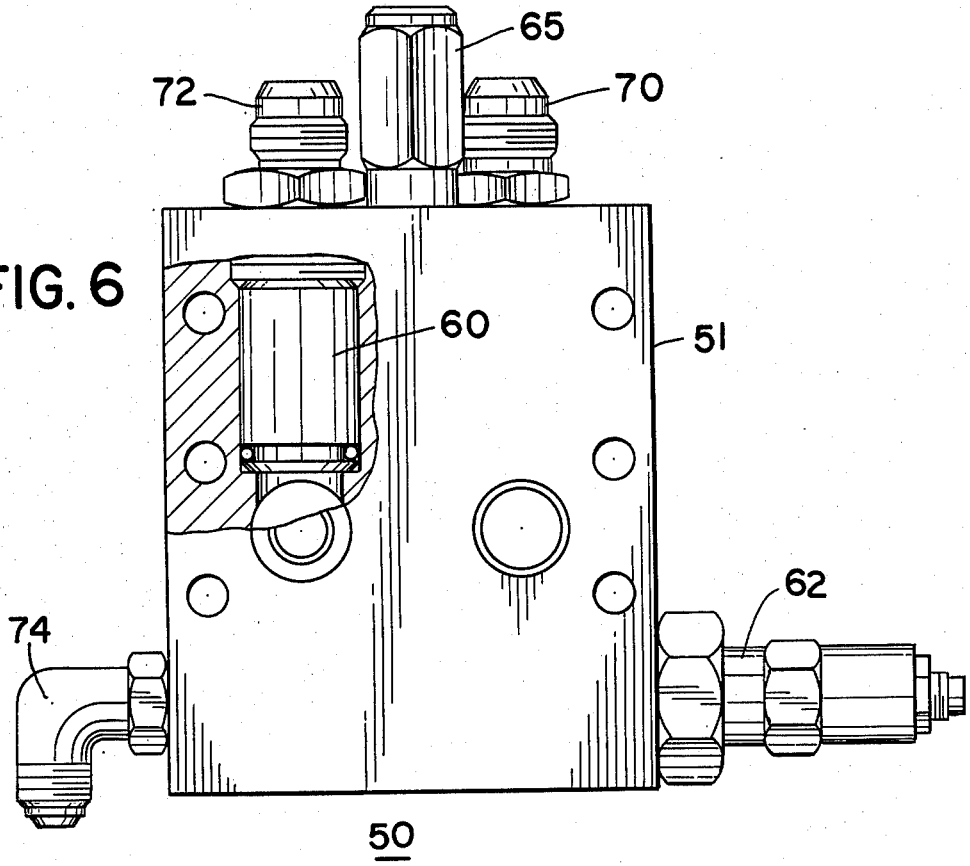
FIG. 6 is a view of the valve assembly of FIG. 5 along the line VI—VI.
Figure 4:
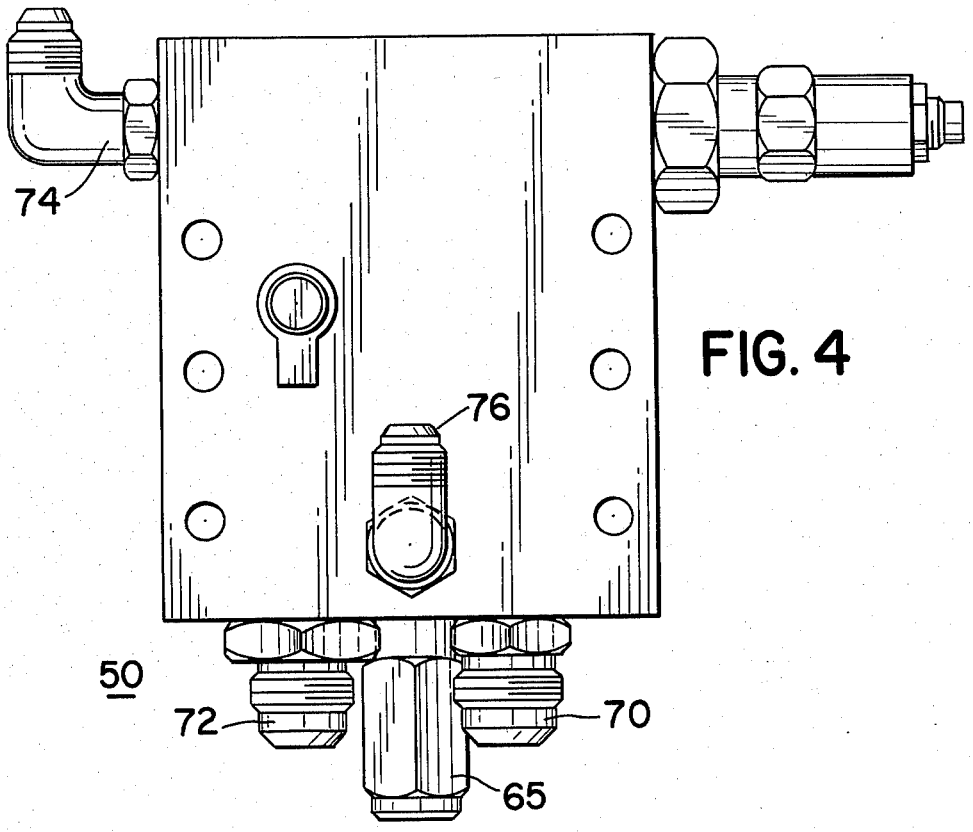
FIG. 4 is a top plan view of a hydraulic valve assembly according to the present invention.
Figure 5:
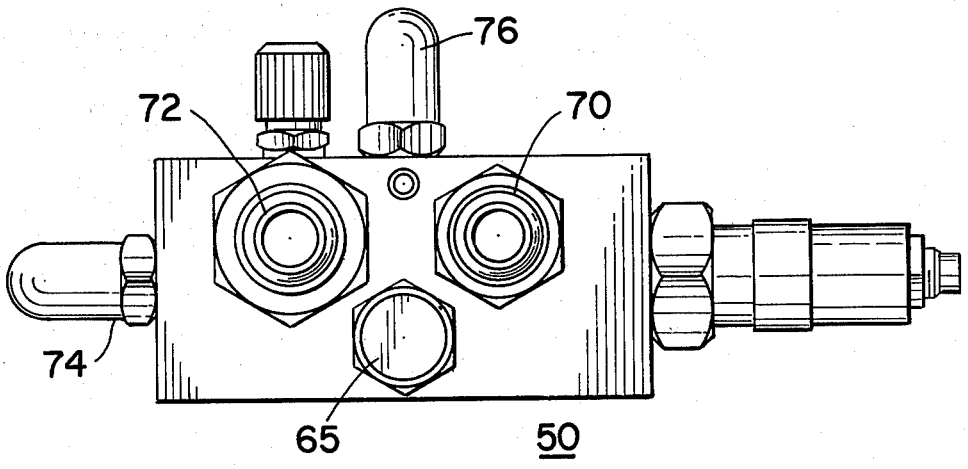
FIG. 5 is a view of the valve assembly of FIG. 4 along the line V—V.

Referring now to FIGS. 4 through 6, there is shown a valve assembly 50 constructed according to the teaching of the present invention. Valve assembly 50 is formed with a single piece main body member 51 having a plurality of internal recesses and channels to provide the necessary interconnections. Connectors 70,72 are provided for connecting the hydraulic hoses 56, 58 respectively. A pilot connector 74 is provided for connecting to a line carrying the pilot signal to open two-way valve 62. An internal passage connects the pilot signal of two-way valve 62. A portion of two-way valve 62 extends outside of main body member 51. A pressure relief check valve 65, which consists of pressure relief valve 64 and check valve 66, is partially exposed on one side of member 51. A connector 76 is provided on main body member 51 to attach to a line which extends to reservoir 43. In use, main body member 51 is secured directly to cylinder 30.

Figure 7:
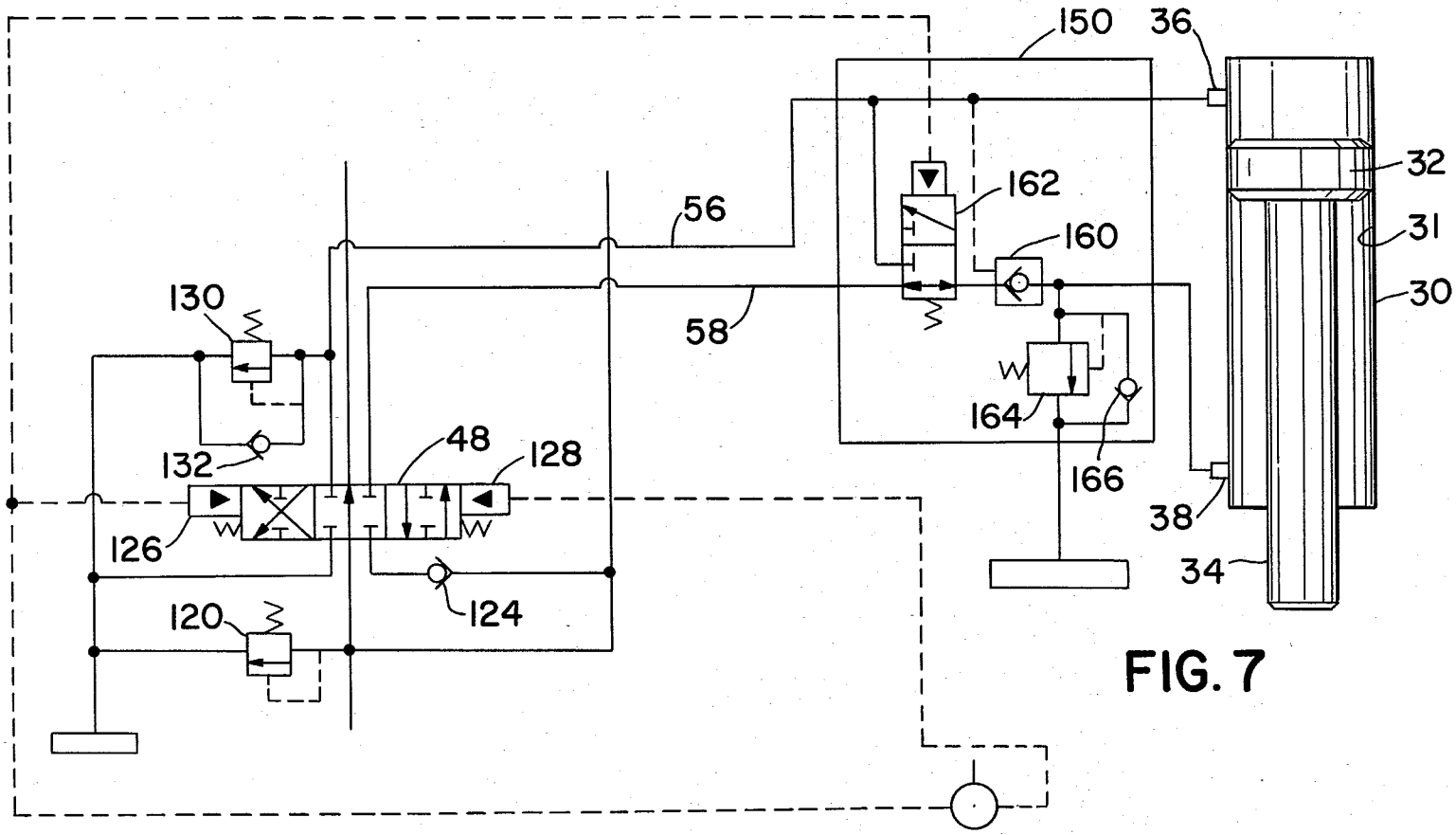
FIG. 7 is a hydraulic schematic of another embodiment of the invention.

Other arrangements of the valves in a valve assembly 50 to prevent return fluid from the rod end of cylinder 30 from flowing through line 58 and controlling the return path of the hydraulic fluid expelled from the cylinder 30 are possible. FIG. 7 illustrates a valve assembly 150 according to another embodiment of the invention. A pilot operated check 160 operates when a predetermined pressure is present in line 56. This occurs when direction control valve 48 is moved to the right and valve 162, which responds to the same pilot signal as direction control valve 48, is moved to a position permitting regenerative flow from port 38 to port 36. When this occurs rod 34 is moved to an extended position. A pressure relief 164 and check valve 166 which function similar to pressure relief valve 64 and check valve 66 of FIG. 3 are also provided.

We claim:

1. An operator controlled excavator having a hydraulic actuator movable between an extending position and a retracted position in response to pressurized hydraulic fluid introduced through a first port or a second port from a remote hydraulic power source and a reservoir through a pair of flexible hydraulic hoses, the improvement characterized by:

a direction control valve connected to one end of said pair of flexible hydraulic hoses positionable at a first position connecting one of the flexible hoses to the source and the other hose to the reservoir, and at a second position reversing the hydraulic hose connections to the source and reservoir;

valve assembly means directly mounted on the hydraulic actuator and connected to the first port and the second port and having the other end of the pair of flexible hydraulic hoses connected thereto, for controlling the flow of pressurized hydraulic fluid into and out of the hydraulic actuator comprising;

a check valve to limit the flow of pressurized hydraulic fluid through one of the flexible hydraulic hose connection to a direction into the second port, a two position valve positionable in response to an operator command to a first position permitting pressurized hydraulic fluid flow from the second port and a second position preventing pressurized hydraulic fluid flow therethru into the second port;

control means responsive to an operator for providing a pilot signal; and, said direction control valve and said two position valve are positionable, at one of their positions in response to a common pilot signal.

2. An excavator as claimed in claim 1 wherein said valve assembly means further comprises:

a pressure relief valve connected to the second port to limit pressure; and, a hydraulic connection extending from the pressure relief valve to a hydraulic reservoir.

3. An excavator as claimed in claim 2 wherein:

said hydraulic reservoir is pressurized; at greater than atmosphere pressure and, said valve assembly means further comprises a second check valve, disposed around said pressure relief valve to permit fluid flow from said hydraulic reservoir to said hydraulic actuator when the pressure at the second port is below the pressure of said hydraulic reservoir to reduce cavitation.

4. A hydraulic operating mechanism comprising:

a hydraulic cylinder having a pair of operating ports;

a hydraulic power supply, located remote from said hydraulic cylinder, having a source and a reservoir;

a pair of flexible hydraulic hoses disposed between said hydraulic cylinder and said hydraulic power supply;

a direction control valve connected to one end of said pair of flexible hydraulic hoses positionable at a first position connecting one of the flexible hoses to the source and the other flexible hose to the reservoir, and at a second position reversing the hydraulic hose connections to the source and return;

a valve assembly mounted on said hydraulic cylinder and connected to the other end of said pair of flexible hydraulic hoses controlling the flow of hydraulic fluid with respect to the pair of operating ports comprising a check valve disposed to permit fluid flow from the source of said hydraulic power supply through either of said pair of flexible hydraulic hoses and to permit fluid flow to the return of said hydraulic power supply through only one of said pair of flexible hydraulic hoses;

a two position valve disposed between the pair of operating ports positionable at a first position not permitting fluid flow therethrough between the pair of operating ports and at a second position fluid flow therethrough between the pair of operating ports;

control means responsive to an operator for providing a pilot signal; and, said direction control valve and said two position valve are positionable, at one of their positions, in response to a common pilot signal.

5. A hydraulic operating mechanism as claimed in claim 4 wherein said valve assembly further comprises:

a second check valve disposed to permit fluid flow from said reservoir to one of the hydraulic cylinder operating ports;

a fluid connection between said second check valve and said reservoir.

6. A hydraulic operating mechanism as claimed in claim 4 wherein said valve assembly further comprises:

a pressure relief valve disposed to limit the pressure of the hydraulic fluid at one of the hydraulic cylinder operating ports.

7. A hydraulic operating mechanism as claimed in claim 6 comprising:

a second pressure relief valve, disposed to limit the pressure of the hydraulic fluid at the other hydraulic cylinder operating port.

8. A hydraulic operating mechanism as claimed in claim 7 comprising:

a check valve disposed around said pressure relief valve; and, a second check valve disposed around said second pressure relief valve.

9. An operator controlled excavator comprising:

a hydraulic power supply providing a source of pressurized hydraulic fluid and a hydraulic fluid reservoir;

a hydraulic actuator assembly movable toward an extended position or a retracted position in response to pressurized hydraulic fluid applied to one of a pair of ports;

direction controlled valve means disposed between said hydraulic power supply and said hydraulic actuator assembly positionable by an operator at a first position for causing said hydraulic actuator to extend and at a second position for causing said hydraulic actuator to retract;

a pair of flexible hydraulic hoses connected between said hydraulic actuator assembly and said direction control valve for carrying hydraulic fluid therebetween;

said hydraulic actuator comprises, a hydraulic cylinder, and a valve assembly mounted directly on said hydraulic cylinder and having said pair of flexible hydraulic hoses connected directly thereto and including a check valve to limit flow there through to a direction to retract said hydraulic actuator;

a two position valve, disposed on said hydraulic cylinder and connected to one of said pair of ports, positionable at a first position to stop fluid flow from the port and at a second position permitting fluid flow in at least one direction from the port;

control means responsive to an operator for providing a pilot signal; and, said direction controlled valve and said two position valve are positionable, at one of their positions, in response to a common pilot signal.

10. An excavator as claimed in claim 9 comprising:

a pressure relief valve connected to one port;

a check valve connected in parallel around said pressure relief valve;

a connection from said pressure relief valve and said check valve to the hydraulic fluid reservoir;

a means for maintaining greater than atmospheric a back pressure on said check valve to cause fluid flow through the check valve toward the port when pressure at the port falls below a predetermined level.

* * * * *